US005433230A

United States Patent [19]

Miller

[11] Patent Number: 5,433,230

[45] Date of Patent: Jul. 18, 1995

[54] EQUIPMENT CONTAINER

[75] Inventor: Vernon B. Miller, Willis, Tex.

[73] Assignee: Shoreline Services, Inc., Willis, Tex.

[21] Appl. No.: 146,602

[22] Filed: Nov. 2, 1993

[51] Int. Cl.[6] ..... B08B 3/02

[52] U.S. Cl. ..... 134/110; 134/155; 134/135; 134/201; 134/200; 206/315.1

[58] Field of Search ..... 134/110, 135, 200, 155, 134/186, 201, 560, 570, 580, 56 R; 206/305, 315.1

[56] References Cited

U.S. PATENT DOCUMENTS

| | | | |
|---|---|---|---|
| 1,473,301 | 11/1923 | Lapham | 134/110 |
| 1,626,125 | 4/1927 | Tilt | 134/110 X |
| 1,995,927 | 3/1935 | Kirby | 134/56 D |
| 2,045,890 | 6/1936 | Uhalt et al. | 134/200 X |
| 2,301,601 | 11/1942 | Wittwer et al. | 134/200 |
| 2,633,726 | 4/1953 | Rand | 134/200 UX |
| 2,641,270 | 6/1953 | Allen | 134/200 |
| 2,667,243 | 2/1954 | Reynolds et al. | 134/200 X |
| 2,697,341 | 12/1954 | Thomas | 134/153 X |
| 2,882,708 | 4/1959 | Hancock | 134/180 |
| 3,050,073 | 8/1962 | McMillan | 134/135 X |
| 3,395,550 | 8/1968 | Dungan | 62/464 |
| 3,399,869 | 9/1968 | Loria et al. | 134/184 |
| 3,655,215 | 4/1972 | Becklin | 280/79.2 |
| 3,979,007 | 9/1976 | Thornbloom, Jr. | 220/23 |
| 4,063,581 | 12/1977 | Williams | 150/52 G |
| 4,066,156 | 1/1978 | Basile | 190/18 A |
| 4,406,353 | 9/1983 | Walker | 190/18 A |
| 4,655,235 | 4/1987 | Scott, Jr. | 134/200 |
| 4,841,661 | 6/1989 | Moore | 43/54.1 |
| 4,951,818 | 8/1990 | Johnson | 206/315.1 |
| 4,996,790 | 3/1991 | Ruggles | 43/55 |
| 5,005,847 | 4/1991 | King et al. | 280/47.19 |
| 5,038,515 | 8/1991 | Moorhead | 43/55 |
| 5,115,289 | 5/1992 | Pond et al. | 190/18 A |
| 5,163,674 | 11/1992 | Reichek | 280/47.26 |
| 5,212,902 | 5/1993 | Moorhead et al. | 43/55 |
| 5,225,160 | 7/1993 | Sanford et al. | 134/200 |

FOREIGN PATENT DOCUMENTS

| | | | |
|---|---|---|---|
| 650330 | 9/1937 | Germany | 134/200 |
| 2247653 | 7/1990 | United Kingdom . | |

OTHER PUBLICATIONS

"Performance Diver," pp. 14, 20, 21, 22; 1993.

"Skin Diver," p. 21, and three pages from Equipment Section, May 1989.

*Primary Examiner*—Frankie L. Stinson

*Attorney, Agent, or Firm*—Guy McClung

[57] ABSTRACT

An equipment container is disclosed with a lid for closing off an interior space thereof and having a body member with a space therein for containing items and with a fluid inlet and fluid outlet so that a fluid may be transmitted through the container to clean, wash, rinse or flush the container's interior and/or items(s) therein. Item separator(s) may be provided to maintain distance between items. A drain protector may be used to inhibit clogging or restriction of drain outlet(s). One or more dry compartments through which fluid does not flow may also be provided. A perforated removable compartment disposable in the container may also be provided. In one aspect the container is made of hard solid wall members. In another aspect the container is made of durable fabric and may have an interior equipment containment liner or bladder which communicates with fluid inlet(s) and outlet(s). Such a bladder or liner may be used with a hard-sided container. An air duct and air movement apparatus may be provided for the introduction of air or hot air into the container.

10 Claims, 3 Drawing Sheets

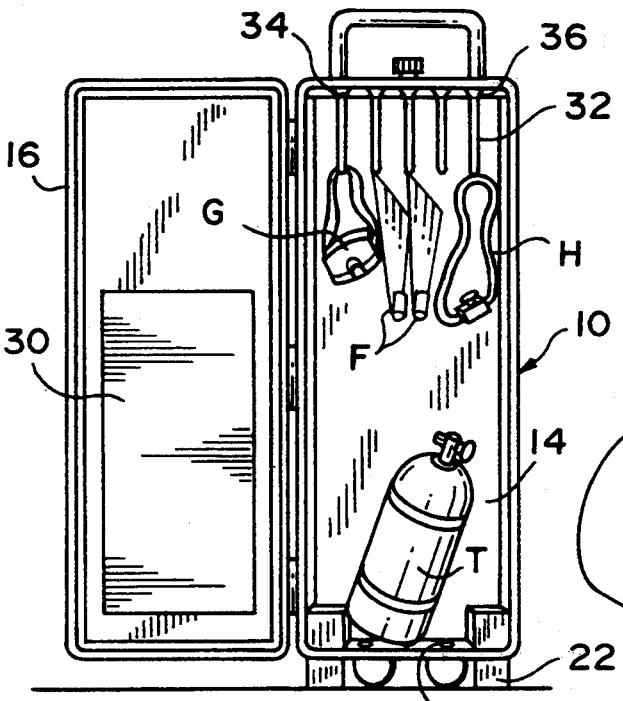
FIG. 1E
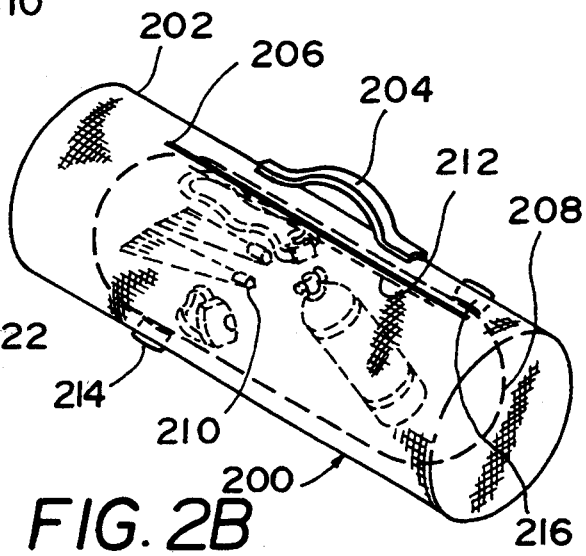
FIG. 6
FIG. 2B
FIG. 2A
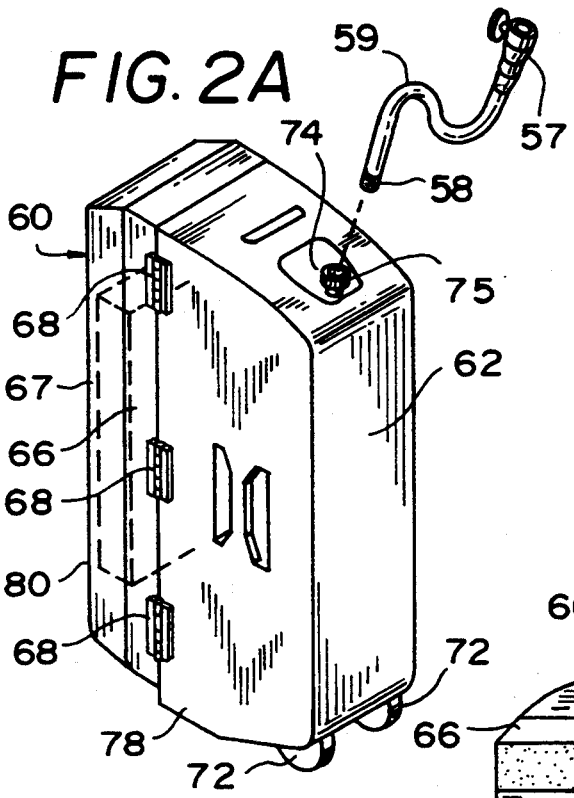
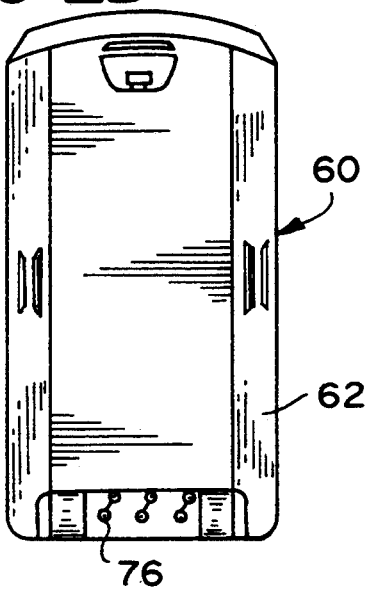
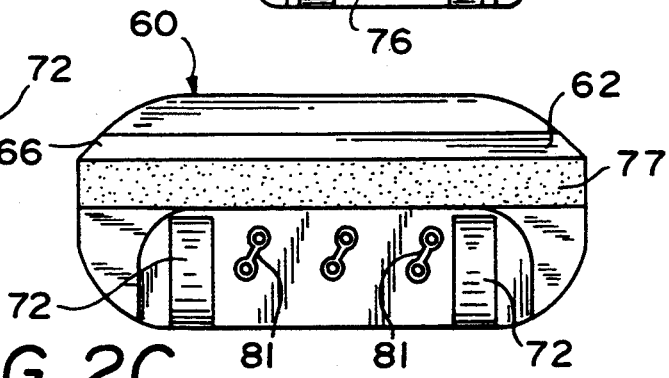
FIG. 2C FIG. 2D
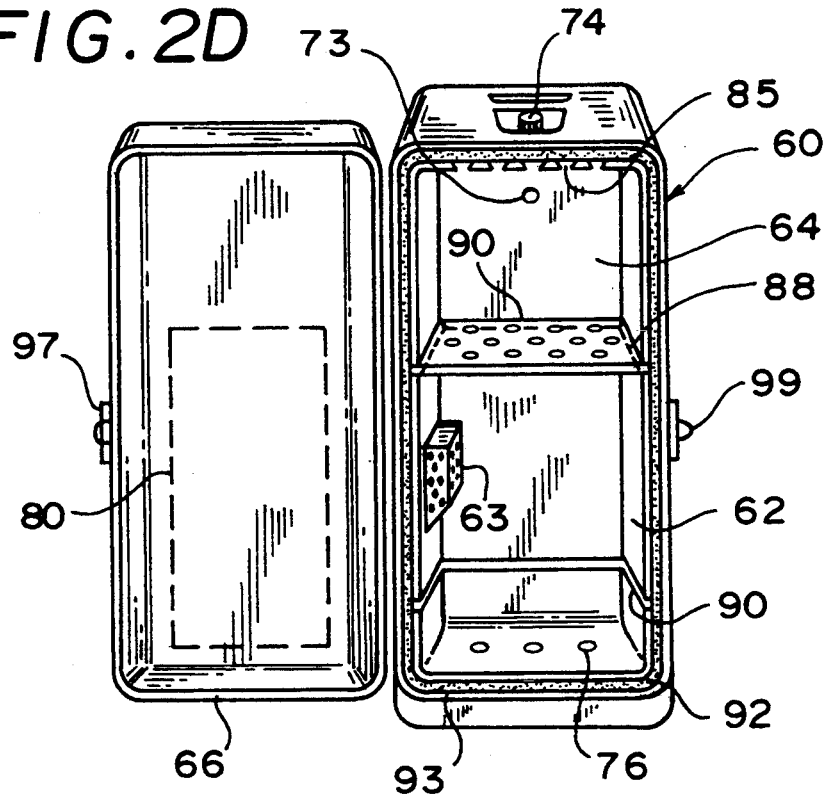
FIG. 3
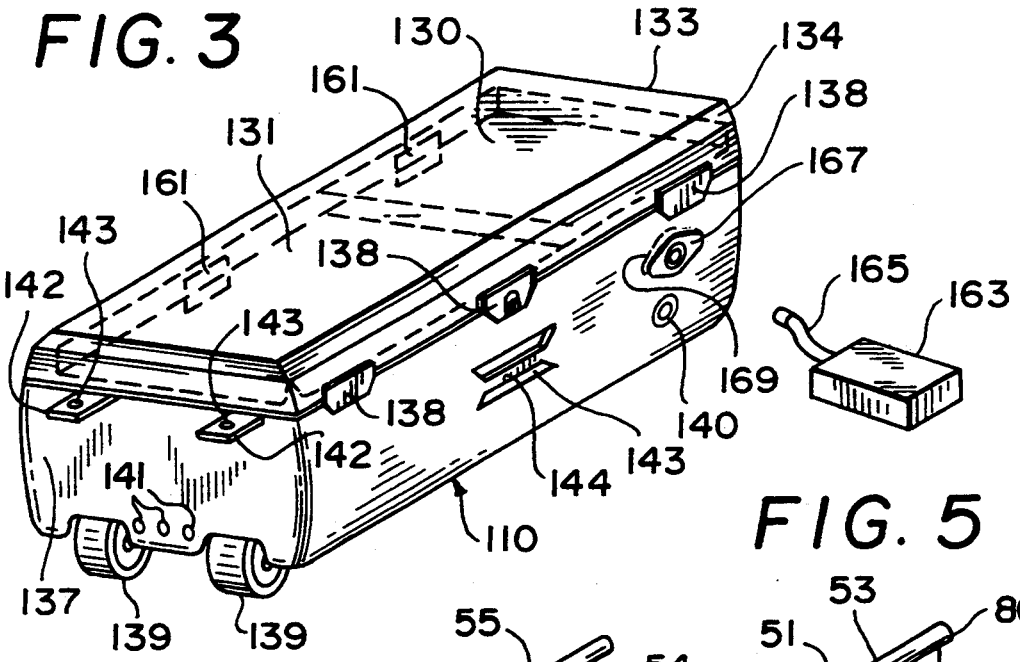
FIG. 5
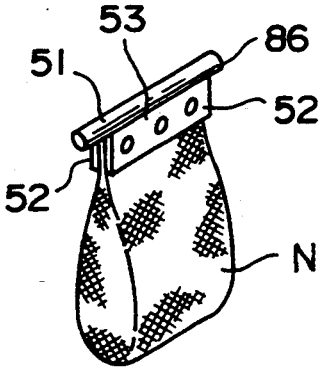
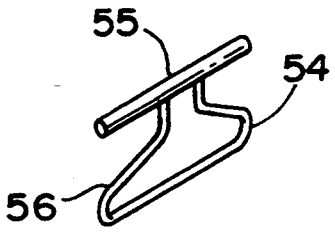
FIG. 4

EQUIPMENT CONTAINER

BACKGROUND OF THE INVENTION

1. Field of the Invention

The present invention is related to equipment containers through which a flushing fluid is passed to clean the container's interior and its contents. In one aspect a container according to the present invention contains fishing or scuba equipment and has inlet and outlet apparatus for flushing clean water through the container to clean the equipment.

2. Description of the Related Art

Personnel at work sites such as construction sites and oil rigs typically get both their clothes and their tools dirty. Sportsmen and sportswomen who engage in various activities, particular in a salt water environment, for example fishing and scuba diving, get their gear and clothes dirty. Often in remote areas there are no adequate facilities for cleaning clothes or equipment. Gear, tools, and equipment that are allowed to remain dirty or contaminated with salt water can corrode and rust damaging them and rendering them unsafe or inoperable. The sooner such equipment is cleaned, the sooner corrosion and rust are inhibited.

SUMMARY OF THE PRESENT INVENTION

The present invention, in one embodiment, discloses an equipment container with a body member having an opening and with a movable lid for opening and closing the container. The container has an inlet apparatus for the introduction of a flushing fluid and outlet apparatus for draining the flushing fluid and any dirt and materials entrained therein from the container. The container may have a handle and wheels to facilitate movement and handling. In one aspect such a container has a compartment through which the flushing fluid does not pass. This dry compartment may either have a sealed closure accessible from the container's interior or it may be formed with an exterior closure accessible exteriorly of an interior flushing compartment. Alternatively such a dry compartment may be provided with a sealable inlet and outlet for conversion to a flushable compartment as described. A buoyant member or material may be placed in the flushing compartment to render the container or the container plus its contents buoyant; or a sealed compartment may be used for this function.

In one aspect a container according to the present invention, called a "Dive Boogie" container, has solid, hard walls. In another aspect a container according to the present invention is made from durable waterproof material or fabric. Either type of container may have an inner liner or bladder which is waterproof and which encloses equipment to be rinsed or cleaned. In one aspect connections, valves and/or conduits are provided for interconnection of a blower and/or heater apparatus so that air and/or heat may be introduced into the container.

To facilitate thorough flushing of tools, equipment, and clothing in a container according to this invention, hooks, holders, bottles, and perforated shelves and compartments are provided within the container to maintain distance between items and to prevent them from covering an outlet or restricting flow through a drain opening.

It is, therefore, an object of at least certain preferred embodiments of the present invention to provide:

- New, useful, unique, efficient, nonobvious equipment containers with inlet(s) and outlet(s) through which a flushing or rinsing fluid is transmitted to clean or rinse the container's interior and/or contents;
- Such containers with one or more dry compartments through which fluid does not flow;
- Such containers with one or more convertible compartments through which fluid flow is selectively permitted or blocked;
- Such containers with interior apparatus for holding equipment; for maintaining distance between individual items; and for preventing clogging or restriction of flow outlet(s);
- Such containers with inlet and/or outlet fixtures for interfacing with available fluid sources and drains;
- Such containers made from appropriate materials or fabric including but not limited to metal, stainless steel, fiberglass or plastic;
- Such containers suitable for cleaning and transporting scuba gear or fishing equipment;
- Such containers which are buoyant or which have buoyant member(s) therein; and
- Such containers into which soap, chemicals, or other solids or fluids are introducible to facilitate cleaning, flushing, or rinsing of container or its contents.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention should be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1E shows the container of FIG. 1A opened up.

FIG. 2A is a perspective view of a container according to the present invention.

FIG. 2B is a rear view of the container of FIG. 2A.

FIG. 2C is an end view of the container of FIG. 2A.

FIG. 2D is a view of the container of FIG. 2A opened up.

FIG. 3 is a front view of a container according to the present invention.

FIG. 4 is a perspective view of a hanger according to the present invention.

FIG. 5 is a perspective view of a container according to the present invention.

FIG. 6 is a perspective view of a container according to the present invention.

DESCRIPTION OF EMBODIMENTS PREFERRED AT THE TIME OF FILING FOR THIS PATENT

Figure 1A:
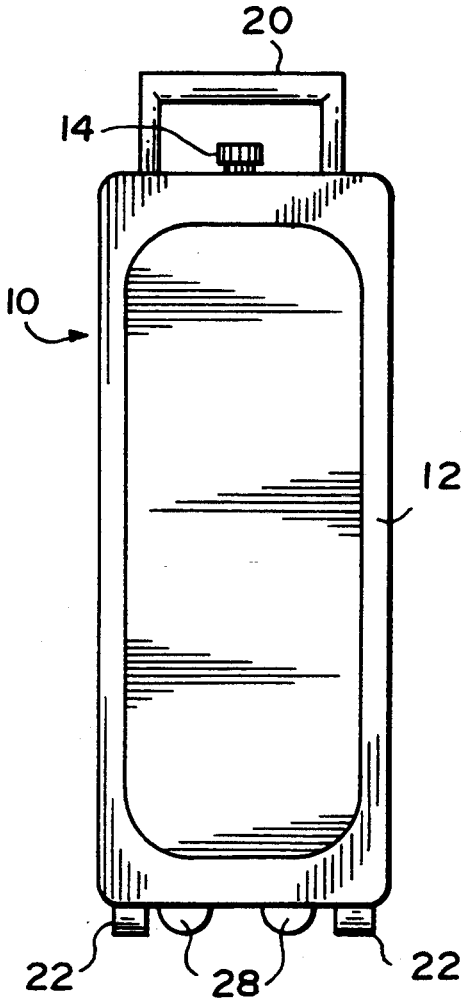
FIG. 1A is a front view of a container according to the present invention.
Figure 1B:
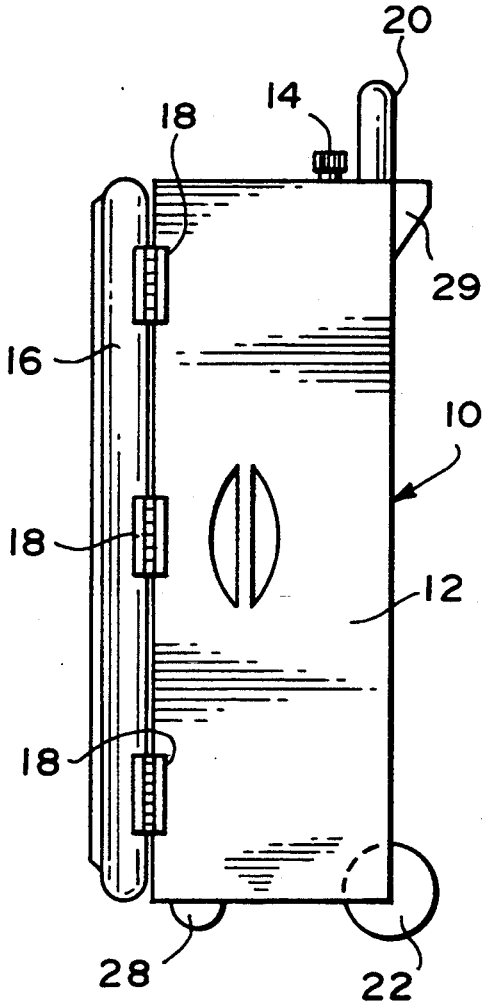
FIG. 1B is a side view of the container of FIG. 1A.
Figure 1C:
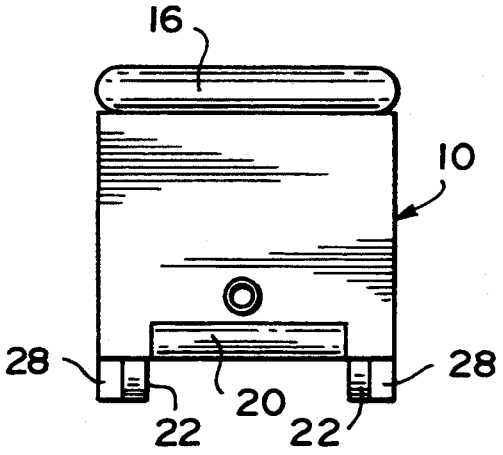
FIG. 1C is a end view of the container of FIG. 1A.
Figure 1D:
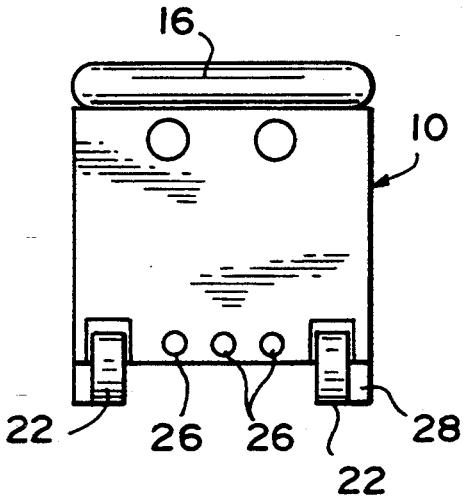
FIG. 1D is an end view of the container of FIG. 1A.

Referring now to FIG. 1A–1E, a container 10 according to the present invention has a body 12 with an interior space 14 and a lid 16 movably connected to the body member by hinges 18. A handle 20 is formed integrally of or secured to the body 12. Two wheels 22 are movably mounted on the body member 12. An inlet connection 14 provides an entry for fluid to be introduced into the body member 12 and also provides a connection point for connecting other apparatus, e.g. hoses or tubing. Three drain outlet holes 26 provide an exit port for fluid flowing from within the body member 12. Supports 28 extending from the body member 12 provide stability to the container 10 when it stands in a position as shown in FIG. 1B. Supports 29 extending from the body member 12 provide stability and horizontal positioning when the container 10 is placed on a flat surface with the lid 16 in a horizontal position.

A dry compartment 30 is removably disposed inside the lid 16. It may be held in place with Velcro TM or a recess may be provided in the lid into which the compartment 30 snaps in place. A plurality of hangers 32 have a hanger top 34 with each hanger top 34 removably mounted in a hanger groove 36. The hanger grooves 36 are formed in the body member 12. As shown a variety of scuba gear is hanging from the hangers 32, including goggles G, swim fins F, an air tank T, and a hose H.

Referring now to FIGS. 2A–2D, a container 60 according to the present invention has a body member 62 with an interior space 64 and a lid 66 hingedly connected to the body member 62 with hinges 68. Recessed handles 70 are molded into the body member 12. A perforated box 63 is removably attached to an interior surface of the container 60. The box 63 may hold items to be flushed or cleaned and/or soap or chemicals. The box may be large enough to simply sit within the container without attachment to its interior surface.

A fluid inlet apparatus 74 has an exterior coupling 75 and an interior orifice member 73. A plurality of drain holes 76 provide an exit port for fluid within the body member 62. Caps 81 are removably emplaceable over or in the drain holes 76 to prevent fluid flow therethrough.

A dry storage compartment 80 is formed within the lid 66 and a cover 67. The cover 67 is connected to the lid 66 with a snug snap fit. Wheels 72 rotatably mounted to the body member 62 facilitate movement of the container 60, particularly when it is full of heavy gear, equipment, or tools. A support portion 78 of the body member 12 provides for stable positioning of the container 60 in a configuration as shown in FIG. 2A. Preferably a non-skid high friction material 77 is adhered to or formed integrally with a bottom of the container to inhibit slipping of the container 60 when it is in the position shown in FIG. 2A. It is within the scope of this invention to provide non-skid material at any point on the container 60 as desired.

Grooves 85 are provided for receiving and holding hanger tops such as those shown in FIGS. 4 and 5. A plate slot 90 around the interior of the body member 62 receives and removably holds a perforated plate such as the plate 88. It is within the scope of this invention to provide two, three, four or more perforated plates 88 spaced apart in the body member 62. It is also within the scope of this invention to provide such a slot and plate adjacent or very near the drain holes 76 to prevent them from being clogged and to inhibit the restriction of fluid flow therethrough, e.g. by a piece of clothing within the container 60. Instead of a perforated plate 88 a perforated baffle or screen may be used for this purpose.

Soap, chemicals, solids, or other material, may be introduced into a container according to this invention through an inlet device or they may be placed within the container prior to closing it.

An O-ring seal 92 in a groove 93 around the lid 66 enhances the sealing of the lid/body member interface. A padlock (not shown) may be used with a flap 97 and a hasp 99 to lock the container 60 shut. container 60 shut.

A hose 59 has a male end 58 which mates with the coupling 75 at one end. The hose 59 has a coupling 57 which is releasably and sealingly securable to a fluid or water emitting device such as a faucet or shower head. This facilitates the introduction of fluid (e.g. water) into the container 60 from any available fluid source. It is within the scope of this invention to provide hoses of different lengths and with different couplings to accommodate a variety of water emitting devices and such devices of varying orifice size and configuration. It is also within the scope of this invention to introduce air or hot air through the coupling 75.

Referring now to FIG. 4 a hanger 56 has hanger body 54 and a hanger top 55 formed for insertion into one of the hanger grooves 84. As shown in FIG. 5 a hanger 86 has a hanger body 53 with two snap closure pieces 52 for holding an item therebetween, e.g. a net bag N as shown in FIG. 5. The hanger 86 has a hanger top 51 insertable into a hanger groove 84.

Referring now to FIG. 3, a container 110 according to the present invention is like the container 60 previously described, but it has two dry compartments 130 and 131 (similar to the dry compartment 80). A lid 133 snap fits into a lid 134. The lid 134 is secured with hinges to a body member 137. Latches 138 releasably secure the lid 134 to the body member 137. Wheels 139 are rotatably mounted to the body member 137. Fluid is introduced through a sealable inlet hole 140 and exits through sealable outlet holes 141. Stabilizing supports 142 for stability when the container is placed on its end have holes 143 for attachment of a cord or the like. A handle 144 across a recess 143 facilitates handling of the container. Air, in one aspect heated air, is propelled from a fan and/or heater device 163, through a hose 165 for introduction into the container 110. A removable cover 167 covers an air inlet 169 into which the hose 165 may be inserted. If desired a hose coupling may be used in place of the inlet 169.

In certain embodiments an interior perforated-wall compartment is provided within the container's body member which compartment includes at least two walls made of perforated plates and one or two walls of the body member. In another aspect a perforated box (or boxes) containing an item or items is removably attached to the container prior to closing the container. Such a box may be any described size and may contain soap etc. or an item to be cleaned, or both.

As shown in FIG. 6, a container 200 according to the present invention has an outer shell 202 made of durable fabric, preferably waterproofed with a strap handle 204 and a sealable opening device 206. An interior bladder 208 holds equipment such as scuba gear 210. The bladder has a sealable opening device 212 corresponding to the sealable opening device 206. A sealable inlet 214 permits rinsing, flushing, or washing fluid to be introduced from outside the container into the bladder's interior and a sealable outlet 216 permits such fluid to exit from the bladder and from the container. With appropriate material used for the outer shell 202, the bladder may be deleted. Such a bladder and related parts may be used in previously-described hard-sided containers according to this invention. The other accessories described above for other embodiments of this invention may be incorporated into the container 200. Also accessories described above for one container may be incorporated into other containers described above.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A transportable container for transporting therein and for flushing therein equipment exposed to saltwater, the container comprising a body member having an opening, an interior space therein for the equipment, fluid inlet apparatus, and fluid outlet apparatus, and a lid releasably securable over or in the opening to close off the interior space of the body member so that fluid is introducible into the interior space through the fluid inlet apparatus to flush equipment within the body member and drainable therefrom through the fluid outlet apparatus, equipment support means removably secured to the body member, at least one dry compartment disposed adjacent to or within the body member, the at least one dry compartment having an interior space isolatable from fluid flowing through the container, the dry compartment having a dry compartment opening and a lid sealably and movably secured over the dry compartment opening so that opening the lid provides access to the dry compartment, and the fluid inlet apparatus including fixture apparatus for interconnecting the fluid inlet apparatus to a water emitting device, the fixture apparatus including a hose and a coupling device thereon suitable for sealing emplacement on a faucet or shower head to facilitate water flow into the container.

2. A transportable container for transporting therein and for flushing therein equipment exposed to saltwater, the container comprising a body member having an opening, an interior space therein for the equipment, fluid inlet apparatus, and fluid outlet apparatus, a lid releasably secured over or in the opening to close off the interior space of the body member so that fluid is introducible into the interior space through the fluid inlet apparatus to flush equipment within the body member and drainable therefrom through the fluid outlet apparatus, at least one dry compartment disposed adjacent to or within the body member, the at least one dry compartment having an interior space, the at least one dry compartment's interior space isolatable from fluid flowing through the container, and the at least one dry compartment having a dry compartment opening and a lid releasably secured over the dry compartment opening so that opening the lid provides access to the dry compartment exteriorly of the container.

3. The container of claim 2 further comprising a buoyant member disposed within the body member.

4. The container of claim 2 comprising also equipment support means connected to the body member for supporting equipment within the body member, the equipment support means comprising at least one perforated shelf removably secured to and within the body member.

5. The container of claim 2 wherein the fluid inlet apparatus includes fixture apparatus for interconnecting the fluid inlet apparatus to a water emitting device, the fixture apparatus including a hose and a coupling device thereon suitable for sealing emplacement on a faucet or shower head to facilitate water flow into the container.

6. The container of claim 2 wherein the fluid outlet apparatus includes at least one fluid drain hole and a drain cap removably securable over the at least one fluid drain hole for selectively closing off fluid flow through the at least one fluid drain hole.

7. The container of claim 2 comprising also at least one compartment mounted within the body member, the compartment having at least two walls made of perforated wall members.

8. The container of claim 2 comprising also a perforated member disposed interiorly of the container about the fluid outlet apparatus for preventing clogging or dosing off of the fluid outlet member by an item disposed within the body member.

9. The container of claim 2 wherein the body member is made of durable fabric.

10. The container of claim 9 comprising also an equipment containment bladder within the body member for containing the equipment therein, the fluid inlet apparatus and fluid outlet apparatus communicating with an interior of the bladder so that the equipment may be flushed within the bladder.

* * * * *